US006019712A

United States Patent [19]

Duncan

[11] Patent Number: 6,019,712

[45] Date of Patent: Feb. 1, 2000

[54] DYNAMIC VARIABLE RESISTANCE BALANCE BOARD

[76] Inventor: James Eugene Duncan, 107 Millstone Dr., Johnson City, Tenn. 37615

[21] Appl. No.: 09/224,925

[22] Filed: Dec. 30, 1998

[51] Int. Cl.[7] ..... A63B 22/16; A63B 21/22

[52] U.S. Cl. ..... 482/110; 482/146; 446/168

[58] Field of Search ..... 482/79, 110, 146, 482/147; 446/168

[56] References Cited

U.S. PATENT DOCUMENTS

| | | | |
|---|---|---|---|
| 3,024,021 | 3/1962 | Coplin . | |
| 3,188,087 | 6/1965 | Larson . | |
| 3,419,267 | 12/1968 | Stolle . | |
| 3,604,726 | 9/1971 | Tracy . | |
| 4,290,601 | 9/1981 | Mittelstadt . | |
| 4,605,224 | 8/1986 | Torii . | |
| 4,632,391 | 12/1986 | Orak | 482/110 |
| 4,653,748 | 3/1987 | Seel et al. | 482/146 |
| 5,584,787 | 12/1996 | Guidry . | |
| 5,603,334 | 2/1997 | Sharp . | |
| 5,647,830 | 7/1997 | Togao . | |

FOREIGN PATENT DOCUMENTS

| | | | |
|---|---|---|---|
| 2592802 | 1/1986 | France . | |
| 2048694 | 12/1980 | United Kingdom | 482/146 |
| 2144646 | 3/1985 | United Kingdom . | |

*Primary Examiner*—John Mulcahy
*Attorney, Agent, or Firm*—Susan F. Wagner

[57] ABSTRACT

A balancing apparatus includes a platform that tilts upon a hemisphere attached to the lower surface thereof. The platform has a grooved track along its periphery. The outermost wall of the track is inclined. A ball is movable around said track upon tilting of the platform and can climb the outermost wall of the track when moved at a fast speed. The ball adds resistance to the tilting of the platform.

13 Claims, 2 Drawing Sheets

DYNAMIC VARIABLE RESISTANCE BALANCE BOARD

FIELD OF THE INVENTION

The present invention relates to exercising equipment. More specifically, the present invention relates to balance boards which are used in physical therapy for rehabilitation and strengthening of leg, foot, ankle, knee, and hip muscles.

BACKGROUND

Balance boards have been used for exercise and amusement. The main feature of a balance board is a rigid platform mounted atop of a rounded base. A person standing on top of a balance board can manipulate the board by rotating and moving his ankles, thereby causing the board to tilt toward the floor. U.S. Pat. No. 3,024,021 discloses a basic balance board.

U.S. Pat. No. 4,605,224 discloses a balance board incorporating a rotatable arm that extends outwardly past the platform. The rotatable arm swings around the balance board in either a clockwise or counter-clockwise direction according to the way that the platform is tilted toward the floor. The disclosed object of using the rotatable arm is for the user to keep the arm turning while maintaining bodily balance.

G.B. Patent 2,144,646A discloses a balance board having a series of interengaging grooves in the center of the face of the platform and a ball for manipulating through the grooves. The foot placement positions are around the perimeter of the platform so that the interengaging grooves are between the user's feet. To use the balance board, the user stands on the board with his feet positioned on two sides of the maze of grooves and manipulates the ball through the grooves by tilting the board via foot and ankle motion. Since interengaging grooves must necessarily be located between the foot positions area, the ankle and knee motion required for manipulation of the ball through the grooves is a relatively small range of motion.

The known balance boards are deficient for use in proprioceptive muscle training. None of the existing boards is specifically designed to aid the user in gaining lower body muscle strength and control for both small and large motions. The balance board of the present invention is beneficial over the existing balance boards in that it allows the user to manipulate a moving object using both small and large muscle movements of the lower extremity(s). This is accomplished by incorporating dynamic variable resistance means as an integral part of the balance board.

SUMMARY OF THE INVENTION

The present invention is a balancing apparatus that comprises a) a rigid platform having an upper surface and a lower surface, said upper surface comprising a center area large enough to accommodate the placement of one or two human feet, said center area surrounded by a continuous grooved track;

b) a pivoting means having a curved end and a flat end, with the flat end being attached to the lower surface of said platform; and c) a resistance means comprising at least one object seated in said grooved circular track, with said object being moveable around said track upon the tilting of said platform.

DETAILED DESCRIPTION OF THE INVENTION

Figure 1:
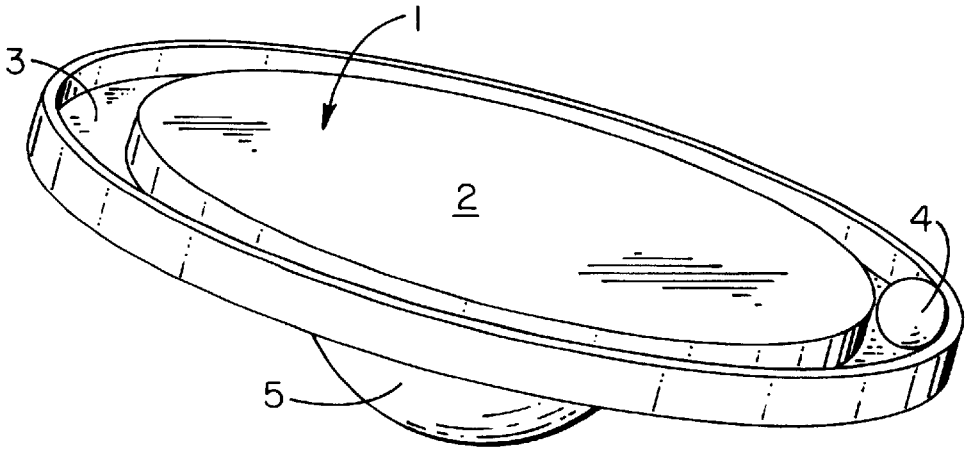
FIG. 1 is an isometric view illustrating the present balance board.
Figure 2:
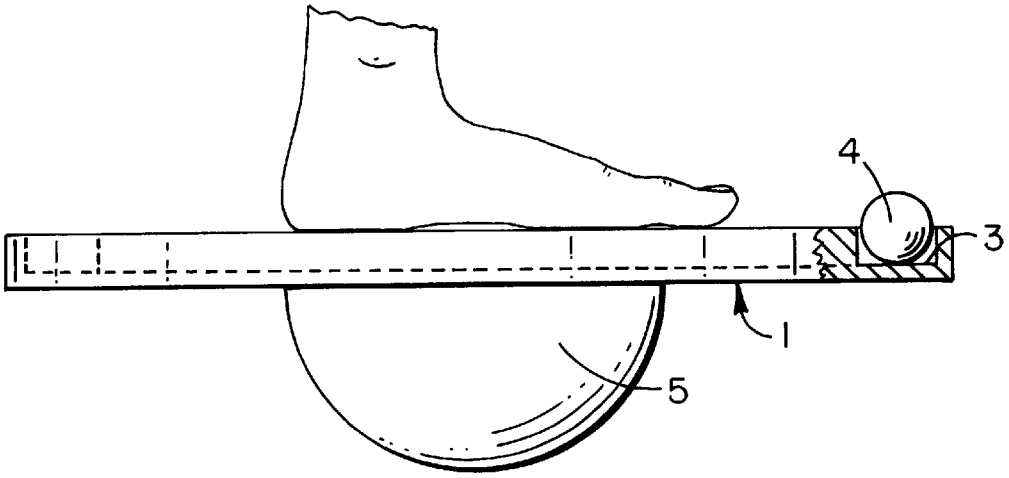
FIG. 2 is a side elevation view of the present balance board with a partial cross-section.

With reference to FIGS. 1 and 2, the balance board of the present invention includes a circular rigid platform 1 that has an upper surface and a lower surface. The upper surface comprises a center area 2 sufficiently large enough to accommodate one or two human feet and a grooved track 3 surrounding the center area 2. The balance board further includes a dynamic resistance means which includes at least one object 4 seated in the grooved track 3. The lower surface of the platform is attached to the flat end of a pivoting means 5 having a curved end and a flat end. The resistance means object is dynamic in that it moves along the track upon tilting the platform in different directions about the pivoting means.

The platform and base are formed from a material strong enough to support a person's weight. A hard material such as wood or plastic is preferable. The platform preferably has a diameter of about 24 to 36 inches (61–91 cm). The center area of the platform should be large enough to accommodate the placement of one or two human feet. It is preferable to have a center area large enough to accommodate two feet so that the balance board can be used optionally to exercise one or both legs at a given time. The center area is a circular area preferably having a diameter between about 20 to 28 inches (51–71 cm). The height and width of the grooved circular track must be sufficient to allow the moveable object of the resistance means to move along the track. The track width is preferably about 3 to 6 inches (8–15 cm).

The rigid platform of the present balance board may have any desired two-dimensional shape. The most useful shape is circular. The grooved track may also form any continuous shape that surrounds the center area. The grooved track preferably lies substantially along the perimeter of the platform to form the same shape as the platform. The track may alternatively form a two-dimensional shape different from the shape of the platform. For instance, an oblong track may lie on a circular platform. The track may lie along the perimeter of the platform or it may lie closer to the center of the platform, as long as there is ample room in the center area for the placement of one or two human feet. The balance board is intended to be used with the feet placed only in the center area.

The resistance means object is preferably a ball. It is especially useful to use balls formed from metal or other high-density material. However, any object that will roll, slide, or otherwise move along the track upon the tilting of the platform is acceptable in the present invention. For the sake of providing a clear illustration of the invention, the object will hereinafter be referred to as a ball. However, the object is not limited to a ball.

The balance board of the present invention is designed so that a patient may carry out proprioceptive training using a combination of the full range of resistance under an unrestricted range of ankle motion. This combination allows for more precise proprioceptive training than was previously available from other balance boards.

Figure 3:
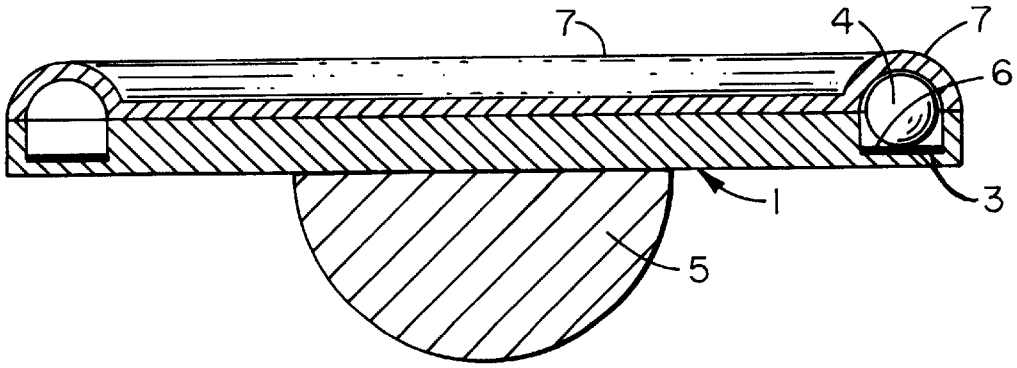
FIG. 3 is a cross sectional side view of the present balance board having a dome lid covering the track.
Figure 4:
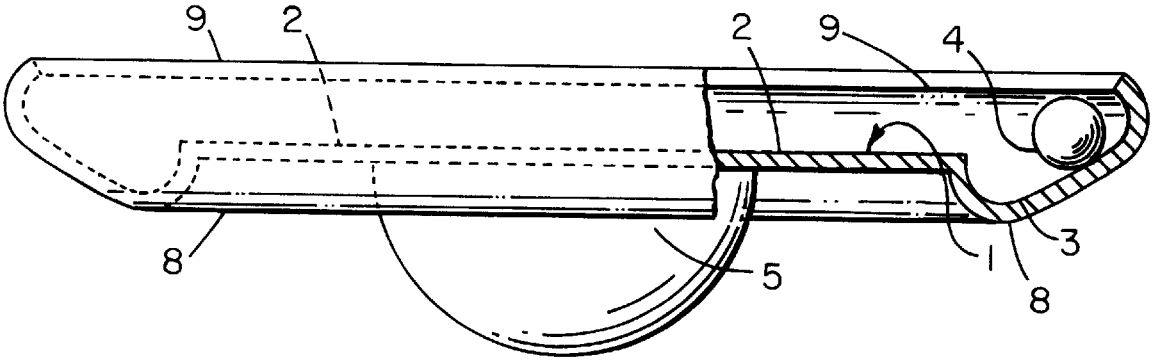
FIG. 4 is a side elevation, and partial cross section, view of the present balance board wherein the track is inclined such that a ball tends to climb the outermost track wall when moving at a fast speed.

The balance board of the present invention is beneficial in that it can be used to exercise against the potential from near full range of motion to very limited range of motion by varying the resistance encountered when manipulating a ball along the track. In a preferred embodiment of the present balance board, the resistance means comprises at least two interchangeable balls of different weights. The different weighted balls provide a different amount of resistance against being rolled around the track. Therefore, different levels of muscle tension are required to manipulate the balls. Useful ball weights range from less than 0.1 pounds to about 10 pounds. Either as an alternative or as additional means of varying the amount of resistance against movement of the ball along the track, the balance board may be equipped with a plurality of interchangeable track surfaces positionable atop the track. FIG. 3 shows an interchangeable track surface 6 lying on top of the track 3. Each of the interchangeable track surfaces has a different degree of coarseness to allow additional degrees of resistance against muscle movement. This provides more levels of resistance against which the ball can be manipulated around the track, thereby requiring a broader range of muscle movement during exercise. Suitable interchangeable track surfaces include easily layered materials such as sandpaper, rubber film, textured fabric, carpet, and such. The interchangeable track surfaces need to be shaped to fit inside the track.

The balance board of the present invention can be manipulated using an unrestricted range of ankle motion used to pivot the board by tilting the pivoting means. The pivoting means is preferably at least substantially hemispherical. However, other irregular shapes may be used for different applications. For example, an elongated dome shape would allow for greater pivoting side to side than backwards and forwards, or vise versa. The pivoting means of the present balance board is preferably a plurality of interchangeable bases having different diameters. A pivoting base having a diameter large enough so that a full ankle motion is required to cause the periphery of the board to touch the floor would require the greatest amount of ankle movement. A pivoting base having a smaller diameter would require a smaller ankle movement. The preferred pivot bases have diameters between about 5 to 10 inches (12.7 to 25.4 cm).

Another aspect of the present invention is that the grooved track may optionally be shaped with an outer wall that has an incline small enough so that the ball can climb the outer wall when moving at a fast speed. The outer track wall for such an embodiment preferably has an outwardly sloping incline forming an angle with the platform of up to about 45 degrees. With such an inclination, the speed of the ball at particular points can be measured, either visually or via electronic sensors.

The preferred balance board of the present invention is equipped with a lid 7 covering the grooved circular track so that the balls do not fall off the track when transporting the balance board. The preferred lid is dome shaped so as to accommodate the balls used on the track. The lid should be openable or removable so as to allow the interchanging of balls and interchangeable track surfaces.

The balance board of the present invention can be used to maximize the proprioceptive exercise response of a patient by tailoring the resistance and range of muscle motion required. The resistance training may include exercising by moving the ball around the track at a predetermined speed, or according to a schedule of varying speeds and directions. The present balance board is very useful in strengthening the muscles, proprioceptive training, increasing muscle control, endurance, and response reaction time in the lower extremities. It also improves muscle re-education and range of motion of the ankles, knees, and hips. The value of the present balance board in proprioceptive training will be apparent to those skilled in the art of physical rehabilitation and exercise physiology.

Although the invention has been described in detail above with specific examples disclosed, any modification or variation made within in the scope or spirit of the disclosed invention is considered as a part of the present invention.

What is claimed is:

1. A balancing apparatus comprising:

a) a rigid platform having an upper surface and a lower surface, said upper surface comprising a center area large enough to accommodate the placement of one or two human feet, said center area surrounded by a grooved track, said grooved track having an inclined outermost wall;

b) a pivoting mechanism attached to the lower surface of said platform to allow tilting of said platform on a support surface; and c) an object seated in said track such that said object is movable around said track upon tilting said platform can climb the outermost wall of said track when moving at a fast speed.

2. A balancing apparatus comprising:

a) a rigid platform having an upper surface and a lower surface, said upper surface comprising a center area large enough to accommodate the placement of one or two human feet, said center area surrounded by a continuous grooved track, said grooved track having an outermost wall having an incline forming an angle with said platform of up to about 45 degrees;

b) a pivoting means having a curved end and a flat end, said flat end attached to the lower surface of said platform adjacently beneath said center area; and c) an object seated in said continuous grooved track such that said object is moveable around said track upon tilting of said track and such that said object can climb the outermost wall of said track when moving at a fast speed.

3. The balancing apparatus of claim 2 wherein said object is a ball.

4. The balancing apparatus of claim 1 wherein the diameter of said center area is about 51 cm to about 71 cm and the maximum diameter of said pivot means is about 12.7 cm to about 25.4 cm.

5. A balancing apparatus comprising:

a) a rigid platform having an upper surface and a lower surface, said upper surface comprising a center area large enough to accommodate the placement of one or two human feet, said center area having a diameter, said center area surrounded by a grooved track, said grooved track having an inclined outermost wall;

b) a pivoting means having a curved end and a flat end, said flat end having a maximum diameter smaller than the diameter of said center area, wherein said flat end is attached to the lower surface of said platform adjacently beneath said center area; and c) a resistance means comprising at least one object seated in said grooved track, wherein said object is movable around said track upon tilting said platform such that said object can climb the outermost wall of said track when moving at a fast speed.

6. The balancing apparatus of claim 5 wherein said platform is circular.

7. The balancing apparatus of claim 5 wherein said platform has a perimeter and said track lies substantially about the perimeter of said platform.

8. The balancing apparatus of claim 5 wherein said resistance means object is a ball.

9. The balancing apparatus of claim 5 wherein said resistance means comprises a plurality of objects interchangeably seatable in and moveable around said track, wherein each of said objects provides a different amount of resistance against being moved around said track.

10. The balancing apparatus of claim 5 wherein said resistance means further comprises a plurality of interchangeable track surfaces fittingly positionable atop of said track and having different degrees of coarseness.

11. The balancing apparatus of claim 5 wherein said pivoting means has a substantially hemispherical shape.

12. The balancing apparatus of claim 7 wherein said hemispherical pivoting means is a plurality of interchangeable hemispherical bases having different diameters.

13. The balancing apparatus of claim 5 further wherein said grooved circular track is covered by a lid sufficient to retain said object.

* * * * *

UNITED STATES PATENT AND TRADEMARK OFFICE

CERTIFICATE OF CORRECTION

PATENT NO. : 6,019,712
DATED : February 1, 2000
INVENTOR(S) : James Eugene Duncan It is certified that error appears in the above-identified patent and that said Letters Patent is hereby corrected as shown below:

Column 6,
Line 5, "7" should be deleted and -- 11 -- substituted therefor.

Signed and Sealed this

Ninth Day of October, 2001

*Attest:*

Nicholas P. Godici

*Attesting Officer*

NICHOLAS P. GODICI
*Acting Director of the United States Patent and Trademark Office*